United States Patent [19]

Nishitani

[11] 3,942,260

[45] Mar. 9, 1976

[54] METHOD AND APPARATUS FOR DRYING THE REFRACTORY LINING

[75] Inventor: Teruyuki Nishitani, Himeji, Japan

[73] Assignee: Nippon Steel Corporation, Tokyo, Japan

[22] Filed: Oct. 30, 1974

[21] Appl. No.: 519,232

[30] Foreign Application Priority Data

Oct. 31, 1973 Japan ..... 48-121682
Dec. 27, 1973 Japan ..... 48-192174

[52] U.S. Cl. ..... 34/4; 34/17; 34/104
[51] Int. Cl.[2] ..... F26B 3/30
[58] Field of Search ..... 34/1, 4, 104, 68, 17

[56] References Cited

UNITED STATES PATENTS 1,806,674 5/1931 Donohue ..... 34/4 X
3,052,987 9/1962 Mercer ..... 34/104 X

*Primary Examiner*—John J. Camby
*Attorney, Agent, or Firm*—Watson Leavenworth Kelton & Taggart

[57] ABSTRACT

The refractory material lined inside a ladle, tandish or other container or sluice, etc. for molten metal can be dried by dielectric heating using microwave. In this case, a space surrounded by a metallic frame and a metallic cover plate can be used as a cavity resonator. If a hot blast is concurrently supplied inside the space, the time for drying can be made shorter.

10 Claims, 6 Drawing Figures

METHOD AND APPARATUS FOR DRYING THE REFRACTORY LINING

DETAILED DESCRIPTION OF THE INVENTION

This invention relates to a method and apparatus for drying such refractory lining as applied to a container or sluice, etc. for handling molten metal by dielectric heating with microwave.

The term "container for molten metal" or "sluice for molten metal," etc. herein used means, for example, the ladle, the truck or furnace for mixing pig iron, the electric furnace, the converter, the tandish, or the like containers used for iron- or steel-making; or the runner or spout for tapping iron or steel, or a sluice used for iron- or steel-making, etc. These containers and sluices have an outer shell composed of a metallic frame and an inner surface lined with a refractory material. This refractory lining is formed by stacked refractory bricks or by coated indefinite refractory material.

In both cases, there is a considerable amount of water contained, for example, in the joint mortar in the former case and in the indefinite refractory material in the latter case. Accordingly, the refractory lining should be dried before receiving the molten metal.

In drying of the refractory lining, it has heretofore been a practice to create an atmosphere having a high temperature more than several hundreds degrees by means of the flame of the gas burner or oil burner, etc., whereby the refractory lining is heated to more than 100°C and the water content in the lining is thereby driven away as a steam.

However, it will naturally give a drastic change of temperature to the refractory material containing a considerable amount of water or form a sharp temperature gradient in the refractory material so that the material will be deteriorated. Accordingly, it becomes necessary to elevate the atmospheric temperature step by step so as to gradually increase the temperature of the surface of the lining, which results in a prolonged drying time. It is also necessary to improve the burner used or the method of combustion to minimize the difference in the temperature.

In the drying process using a flame as set forth above, however, it has so far been unavoidable that the refractory material cracks with a result of deterioration, whether the drying is effected by gradual heating for a long time or by uniform heating. In addition, in the conventional heating by flame, the rate of increase in temperature is made extremely slow since the heating is effected with respect to the adiabatic material. Consequently, the water value in the surface portion of the material will readily evaporate in a short time, while the water value in the middle or deep portion of the material diffuses slowly so that the time for drying will be prolonged more or less depending upon the material used or the thickness thereof.

It is therefore an object of the invention to overcome the disadvantages as set forth above.

According to this invention, there is provided a method for drying the refractory lining of a container or sluice, etc. used for handling molten metal which comprises providing a space which is defined by the metallic frame of said container or sluice, etc. and by a metallic cover plate for covering the opening of said container or sluice, etc., and effecting dielectric heating with microwave by the use of said space as the cavity resonator. There is also provided, according to this invention, an apparatus for drying the refractory lining for the container or sluice, etc. for the molten metal which comprises the metallic frame of said container or sluice, etc., a metallic cover plate for covering the opening of said container or sluice, etc., said frame and said cover plate forming a cavity resonator, a microwave generator and an exhaust pipe provided on said cover plate, and means for preventing leakage of said microwave provided in the part of said exhaust pipe.

In one aspect of the method of this invention, a hot blast may be supplied into said space while said dielectric heating is effected. In one aspect of the apparatus of this invention, a blower pipe with or without a ventilation guide may be provided.

In the practice of this invention dielectric heating with microwave is effected whereby, regardless of the material used and the thickness thereof, the water value contained in the refractory material can be directly heated and thus converted into steam, which escapes from the refractory material to fulfil complete drying.

It has been known that dielectric heating can be used to remove water from various materials. However, in the practice of dielectric heating using microwave, this microwave will easily pass through the refractory material without substantial action upon the material, which results in the radio wave troubles, adverse effects upon human beings, etc. For this reason, it has not actually be practised for drying refractory lining for the container or sluice, etc. for the molten metal.

After various studies by the inventors about dielectric heating using microwave, they have found that the metallic frame constituting the outer shell of the container or sluice, etc. serves to prevent the above microwave from passing therethrough, and established a method for drying by means of dielectric heating with microwave wherein the openings of said container or sluice, etc. such as an inlet or an outlet for the molten metal of a ladle, are all covered by a metallic cover so that a space shut out by the frame member and the cover member composed of a metallic material is formed to act as a cavity resonator.

As far as the space shut out by the metallic material is concerned, it is most preferable from the standpoint of preventing the leakage of microwave that the space is under sealed condition by means of the metallic material. However, in order to dry the same it is desirable to form an outlet for the steam escaping from the refractory material. This outlet for the steam should thus function to pass the steam but not to pass the microwave therethrough. In this invention, an outlet for the steam or an exhaust pipe is provided at a predetermined position on the metallic cover plate which constitutes a part of the space, and means to prevent leakage of the microwave such as a metallic wire mesh or perforated or porous plate, a metallic slit plate, or a bundle of metallic pipes, etc. is arranged in the opening of said cover plate. The way of arranging said means or the size of the mesh, hole, the distance between the slits or the diameter of the bundle pipes therefor depend on the wave length of the microwave. Alternatively, the means for preventing leakage of the microwave may adopt a system for diverting the movement of the microwave by means of magnetic power.

The space shut out by the metallic material as constructed above is used as the cavity resonator. When the microwave is generated from the microwave generator provided in this cavity resonator or on the metallic cover plate, the water value contained in the refractory lining can be heated rapidly and uniformly to produce a steam regardless of the material used and the thickness thereof, which steam will evaporate sequentially from the surface of the refractory material to proceed drying. Thus the drying of the material can be fulfilled by continuing the dielectric heating with the microwave for a predetermined time.

When the permanent lining which does not substantially necessitate drying is applied as the refractory material, it is preferable to provide a reflecting plate made of metallic foil, metallic wire mesh, etc. over the entire surface of the permanent lining or between the permanent lining and the wear lining, which serves to promote the efficiency for drying.

The output of the microwave should preferably be 5 kw/t (refractory) or more. If it is lower than that, there is a fear that it preserves an equilibrium with the amount of heat discharged, which is of course undesirable.

The invention is further described with reference to the drawings.

Figure 1:
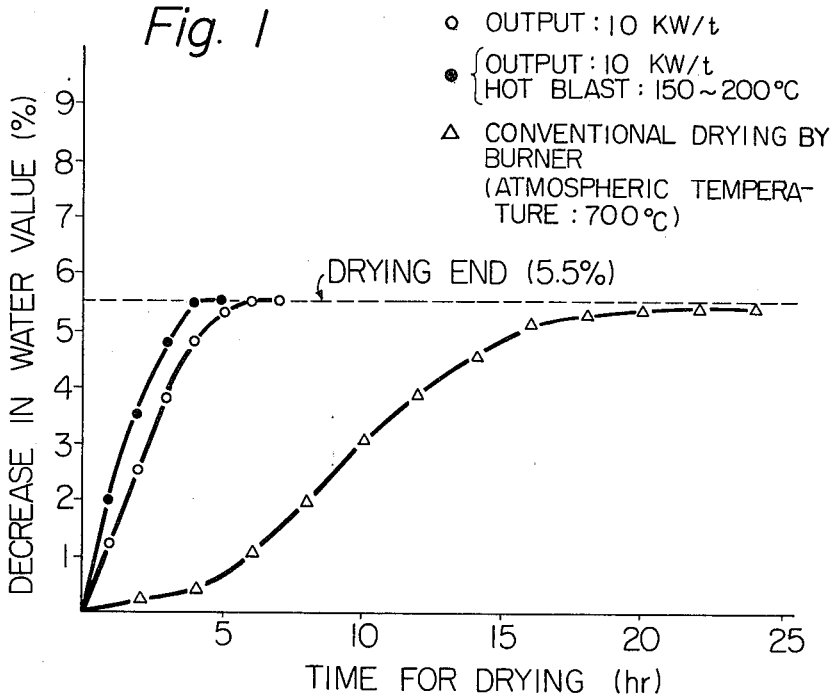
FIG. 1 is a graph showing the advantages of the method of the invention over the conventional method.

As shown in FIG. 1, the drying can be done for a short time by drying the refractory lining by dielectric heating with microwave. When, in addition, a hot blast is supplied into the cavity resonator in the course of the abovementioned drying, the evaporation of the water value from the refractory material can be promoted. As a result, the time for drying by means of the dielectric heating with the microwave can be made much shorter and the drying can be effected much more economical.

The temperature of the hot blast corresponds to the detectable or sensible heat which is not less than the boiling point of the water, for example, at least 100°C. It is not necessary, however, to increase this heat so high, and a degree up to 300°C will be sufficient.

The microwave transmitted from the microwave generator as set forth above is consumed for drying the refractory lining in a container or sluice, etc. After the drying is over, the microwave is reflected by the metallic material and then returns to the side of the microwave generator. In this case, however, there is a problem that it will injure the microwave generator. In order to solve the problem, a circulator is provided near the microwave generator whereby the direction of movement of the microwave is controlled so that it will be absorbed by an isolator. Alternatively, the operation may be done for a predetermined drying time which has been determined experimentally, or the end-point of drying may be substantially detected by measuring the temperature of the discharged gas in case of the compulsory exhaust or by measuring the water value in the atmosphere.

Figure 2:
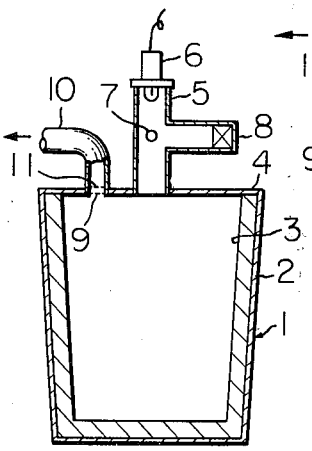
FIGS. 2 and 6 are preferable examples of apparatus adapted for use in the practice of this invention.

In FIG. 2, an embodiment of the invention is shown wherein the refractory lining for a ladle is dried according to the method of this invention. A refractory lining 3 is provided inside an iron plate 2 which constitutes an outer shell for a ladle 1. A cover plate 4 made of iron is mounted over the ladle 1, upon which plate 4 is set a microwave generator 6 via a circulator 5. The numeral 7 indicates a ferromagnetic member which acts to divert the microwave. The numeral 8 is an isolator which absorbs the extraneous microwave. In the above cover plate 4, there is provided an opening 9, upon which an exhaust pipe 10 is mounted. A wire mesh 11 is also provided on this opening 9.

When an electric current is passed through the generator 6, the space surrounded by the iron plate 2 and the cover plate 4 acts as a cavity resonator whereby the water value existing in the refractory lining 3 is caused to evaporate by means of the dielectric heating with microwave and is discharged from the exhaust pipe 10. When the drying approaches to end, the extraneous microwave is collected and absorbed by the isolator 8 via the circulator 5.

Figure 3:
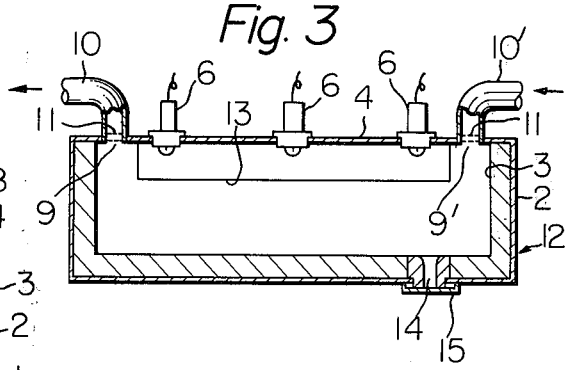
FIG. 3 shows another embodiment of the invention.

FIG. 3 shows an embodiment of the invention in which the refractory lining for a tandish is dried according to the invention. The interior circumference of the iron plate 2 constituting the outer shell for a tandish 12 is lined with the refractory material 3. On the tandish 12, there is provided cover plate 4 made of iron. A plurality of microwave generators 6 are mounted on the cover plate 4. Since the length of the tandish 12 is longer than the width thereof, there is a problem that a fluctuation in drying tends to occur if the drying is effected for a short time. This is the reason why a plurality of the microwave generators, or the three generators in this case, are mounted. In front of the generators 6 inside the cover plate 4, there is provided a protecting frame 13 made of glass in order to protect the generators 6 from steam, etc.

On either side of the cover plate 4, the openings 9 and 9' are provided, and upon these openings, the exhaust pipe 10 and the blower pipe 10' are provided, respectively. Also wire mesh 11 is mounted on these openings 9 and 9'. A tapping hole 14 for discharging the steel which is set on the bottom of the tandish 12 is covered by a cap 15 made of iron. When an electric current is passed through the microwave generators 6 for a predetermined time while a hot blast is circulated by means of the pipes 10 and 10', the space surrounded by the iron plate 2, iron cover plate 4 and the iron cap 15 acts as a cavity resonator so that the water value in the refractory lining is caused to evaporate by means of the dielectric heating with the microwave. As a result, a uniform and effective drying can be effected.

Figure 4:
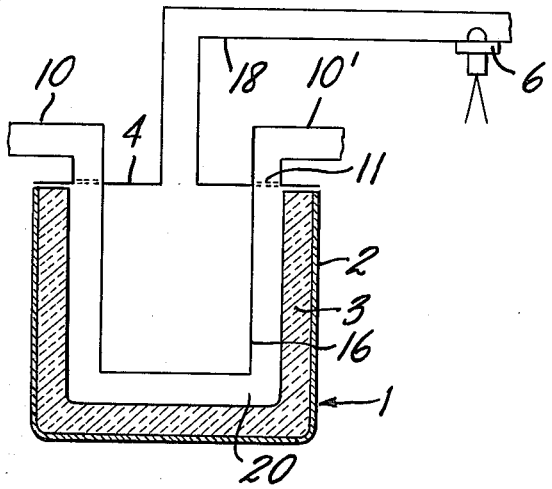
FIG. 4 shows an embodiment of the invention with a microwave generator.

FIG. 4 shows an embodiment in which the microwave generator 6 is provided on the metallic cover plate 4 via a wave guide pipe 18. Under the plate 4, there is provided a ventilation guide 16. It may be made of a material having heat resistivity but having a small coefficient of loss for the microwave such as a Teflon resin, glass, various ceramics, etc. A flow path 20 can be created by the outer surface of the guide 16 and the surface of the lining 3, through which a hot blast is effectively brought into contact with the surface of the lining 3.

Figure 5:
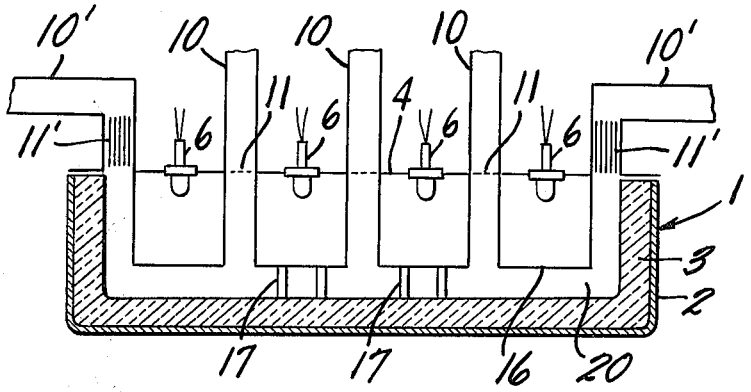
FIG. 5 shows an embodiment of the invention applied to an elongated container.

FIG. 5 shows an embodiment in which an elongated container 1 such as a tandish is used. In this case, the blower pipes 10' are provided on either side of the container 1, between which a plurality of exhaust pipes 10 are provided. The flow path 20 is formed so as to interconnect the same to the exhaust pipes 10. A bundle of metallic pipes having small diameter are used in this case near the part of the blower pipes 10'. The numeral 17 indicates a supporting stand.

Figure 6:
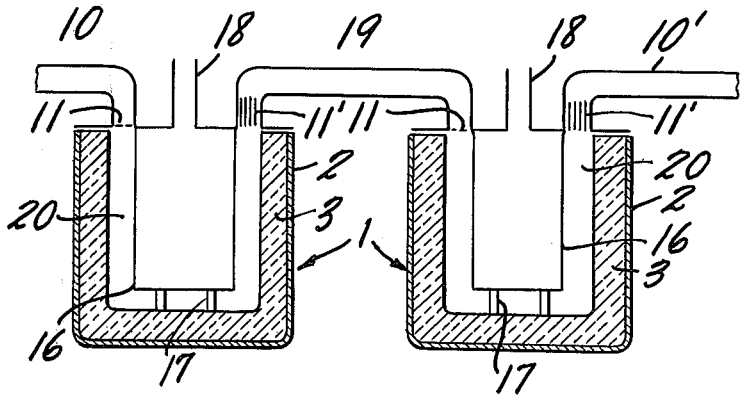

FIG. 6 shows an embodiment in which two containers 1 such as ladles are dried simultaneously, and a connecting pipe 19 is fixed therebetween.

EXAMPLE

A ladle similar to that shown in FIG. 2 was lined with an indefinite refractory material (water content 6.0 percent) of pyrophyllite and zircon type. After 24 hours aging, drying was effected according to the conventional method and the method of this invention. The result is shown in a graph of FIG. 1.

In the practice of this invention, a microwave generator of 2450 MHz, 10 KW/t output was used with or without the supply of a hot blast at 150° to 200°C.

It is obvious from the graph that the drying according to this invention can be done by about 1/5 hours shorter than the conventional method. In case of using the hot blast simultaneously with the above method, the effect was more remarkable.

The observation made after the drying shows that in the conventional method the refractory material was considerably deteriorated with numerous slight cracks and a small number of larger cracks of 10 mm or more in the surface of the material while in this invention the refractory material was not substantially changed, almost no cracks being seen in the surface of the material.

As set forth hereinabove, the metallic frame for a container or sluice, etc. for molten metal and the metallic cover plate covering the opening thereof form the space, which can be used as the cavity resonator for dielectric heating with microwave in the operation of this invention. Accordingly, the water value in the refractory lining is heated and evaporated rapidly and uniformly irrespective of the material used or the thickness thereof. As a result, the refractory lining can be dried without fail for a short time.

Moreover, in this invention, what is used as the cavity resonator is the space which is constituted such that the ventilation or circulation of gas is made possible while the microwave can be shut off. Consequently, there is no fear of troubles for the electric wave as well as human beings in the course of the drying operation. Particularly in case of supplying hot blast inside the cavity resonator, the time necessary for drying can be made shorter on a more economical basis.

I claim:

1. A method for drying the refractory lining of a ladle, tandish or like device for containing molten metal to remove water from said refractory, said device comprising an outer metallic shell and an inner lining of refractory material in said shell, said device enclosing a space for normally holding molten metal, said device having an open top, said method comprising:

positioning a metallic cover on top of said device to fully enclose the space therein and thereby constitute said space a cavity resonator, supplying microwave energy to said cavity resonator to effect dielectric heating of said refractory material sufficient to cause evaporation of water therefrom as steam, and removing steam from said space.

2. The method according to claim 1 in which the microwave energy is supplied at a level of at least about 5KW/t (refractory).

3. The method according to claim 1 further comprising supplying a hot blast of gas through said space during the dielectric heating of said refractory material.

4. A method according to claim 3 in which the hot blast of gas has a temperature of between 100°C and 300°C.

5. Apparatus for drying the refractory lining of a ladle, tandish or like device for containing molten metal to remove water from said refractory, said device comprising an outer metallic shell and an inner lining of refractory material in said shell, said device enclosing a space for normally holding molten metal, said device having an open top, said apparatus comprising the combination with said device of a metallic cover receivable on top of said device to fully enclose the space therein and thereby constitute said space a cavity resonator, means for supplying microwave energy through said cover to said cavity resonator to effect dielectric heating of said refractory material sufficient to cause evaporation of water therefrom as steam, and an exhaust conduit connected to said cover and communicating with said space through which steam can be removed from said space.

6. The apparatus of claim 5 in which the means for supplying microwave energy comprises a microwave generator, said microwave generator being carried in a wave guide pipe connected to said cover, there being a diverter of ferromagnetic material disposed in said wave guide pipe, and an isolator for absorbing microwave energy, said diverter functioning to divert extraneous microwave energy to said isolator.

7. The apparatus of claim 5 further comprising means disposed in said exhaust conduit for preventing leakage of microwave energy from said cavity resonator through said exhaust conduit.

8. The apparatus of claim 4 further comprising a gas supply conduit connected to said cover and communicating with said space for supplying a hot blast of gas to said space during the dielectric heating of said refractory material, there being means disposed in said gas supply conduit for preventing leakage of microwave energy from said cavity resonator through said gas supply conduit.

9. The apparatus of claim 8 in which the means disposed in said exhaust conduit and said gas supply conduit is one of metallic wire mesh, a bundle of metallic pipes, a perforated plate, and a metallic slit plate.

10. The apparatus of claim 8 further comprising ventilation guide means disposed within said cavity resonator and defining with said refractory, a gas flow course interconnecting said exhaust conduit and said gas supply conduit, said ventilation guide means being characterized by having a small coefficient of loss for microwave.

* * * * *

UNITED STATES PATENT AND TRADEMARK OFFICE

CERTIFICATE OF CORRECTION

PATENT NO. : 3,942,260

DATED : March 9, 1976

INVENTOR(S) : Teruyuki Nishitani

It is certified that error appears in the above–identified patent and that said Letters Patent are hereby corrected as shown below:

At Col. 6, line 43, (Claim 8), "claim 4" should read --claim 7--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*